US006514087B2

(12) United States Patent
Kuratani

(10) Patent No.: US 6,514,087 B2
(45) Date of Patent: Feb. 4, 2003

(54) ROTARY ELECTRIC PART

(75) Inventor: Junichi Kuratani, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 39 days.

(21) Appl. No.: 09/795,237

(22) Filed: Feb. 27, 2001

(65) Prior Publication Data

US 2002/0050761 A1 May 2, 2002

(30) Foreign Application Priority Data

Mar. 1, 2000 (JP) ..... 2000-060365

(51) Int. Cl.[7] ..... H01R 39/00
(52) U.S. Cl. ..... 439/18
(58) Field of Search ..... 439/9, 11, 12, 439/13, 21, 29, 30, 18

(56) References Cited

U.S. PATENT DOCUMENTS 4,558,513 A * 12/1985 Buss ..... 29/622
4,855,541 A * 8/1989 Yamashita et al. ..... 200/565
4,978,491 A 12/1990 Yagi et al. ..... 264/154
5,008,498 A * 4/1991 Yamazaki ..... 200/11 R
5,010,214 A * 4/1991 Yamazaki ..... 200/11 G

FOREIGN PATENT DOCUMENTS

JP 8-329776 12/1996
JP 2564057 11/1997

* cited by examiner

*Primary Examiner*—Tulsidas Patel
(74) *Attorney, Agent, or Firm*—Brinks Hofer Gilson & Lione

(57) ABSTRACT

A rotary electric part is disclosed which permits standardization of components and which is inexpensive. A shaft member and a rotary member are formed as separate members, so both can be fabricated separately and then combined together, whereby the standardization of components can be attained and it is possible to provide a less expensive rotary electric part.

12 Claims, 16 Drawing Sheets

ROTARY ELECTRIC PART

BACKGROUND OF THE INVENTION

1. Field of the Invention

The present invention relates to a click structure of a rotary electric part used in a vehicular air conditioner for example.

2. Description of the Prior Art

A conventional rotary electric part will now be described with reference to FIGS. 32 and 33. A case 21, which is formed by molding a synthetic resin, comprises a square base portion 21*b* having a ring-like recess 21*a* and a cylindrical support portion 21*d* having a central through hole 21*c*. Plural contact pieces 22 are embedded in the base portion 21*b* of the case 21.

A shaft member 23, which is also formed by molding a synthetic resin, comprises a shaft portion 23*b* having a central through hole 23*a* and a ring-like rotary member 23*c* provided at a lower end of the shaft portion 23*b*. The shaft portion 23*b* and the rotary member 23*c* are formed integrally by molding and the shaft portion 23*b* is formed in the shape of a straight cylinder almost equal in diameter throughout the whole thereof.

A conductive pattern 24 as a code pattern is formed on the underside of the rotary member 23*c*. In the shaft member 23 provided with the conductive pattern 24, the support portion 21*d* is inserted through the through hole 23*a* and the rotary member 23*c* is received into the recess 21*a*, whereby the shaft member 23 is secured to the case 21 rotatably.

A mounting plate 25, which is a metallic plate, comprises a flat plate portion 25*b* having a hole 25*a*, a pair of leg portions 25*c* bent at a right angle from the flat plate portion 25*b*, and plural mounting portions 25*d* also bent at a right angle from the flat plate portion 25*b*. The shaft portion 23*b* and the support portion 21*d* are inserted from their front end portions into the hole 25*a*, allowing one side of the rotary member 23*c* to be covered with the flat plate portion 25*b*, and lower ends of the leg portions 25*c* are bent toward the underside of the case 21 to mount the case 21 and the shaft member 23 with each other. Thus, the mounting plate 25 functions as both a mounting means and a housing.

In the rotary electric part thus constructed, when the shaft portion 23*b* of the shaft member 23 is rotated, both rotary member 23*c* and conductive pattern 24 rotate and the contact pieces 22 come into sliding contact with the conductive pattern 24, producing a pulse signal.

In such a rotary electric part, a knob (not shown) can be attached to a front part of the shaft portion 23*b*. In this case, since there are knobs of various shapes and constructions, it is necessary to provide a variety of knobs 23*b* for conformity with such various shapes and constructions. Also as to the conductive pattern 24 it has so far been necessary to provide a variety of conductive patterns.

In the conventional shaft member 23, since the shaft portion 23*b* and the rotary member 23*c* having the conductive patterns 24 are formed integrally with each other, it is necessary to provide a different mold each time one of the shaft portion 23*b* and the conductive pattern 24 is different. This results in not only an increase of cost but also the necessity of providing various shaft members 23.

In the conventional mounting plate 25, at every change in diameter of the shaft portion 23*b* to which a knob is to be attached, it is necessary to provide a mounting plate 25 of a different hole 25*a*, thus requiring the provision of various mounting plates 25, which leads to an increase of cost.

Such a rotary electric part is mounted to a printed circuit board (not shown) and, as shown in FIG. 32, a push-button switch 26 is disposed on the printed circuit board which is positioned within the through hole 21*c*, to operate the electric part.

Since the support portion 21*d* of the case 21 and the shaft 23*b* of the shaft member 23 are cylindrical, the rotary electric part is superior in space factor, permitting another electric part to be disposed in the central space.

In the shaft member 23 of the conventional rotary electric part, since the shaft portion 23*b* and the rotary member 23*c* having the conductive pattern 24 are integrally formed by molding, it is required to provide a different mold each time either the shaft portion 23*b* or the conductive pattern 24 is different, thus giving rise to the problem that not only the cost increases but also various shaft members 23 must be provided.

In the conventional mounting plate 25, moreover, a mounting plate 25 of a different hole 25*a* must be provided at every change in diameter of the shaft portion 23*b* to which a knob is to be attached, thus giving rise to the problem that various mounting plates 25 are needed and the cost increases.

SUMMARY OF THE INVENTION

Accordingly, it is an object of the present invention to provide a rotary electric part which permits standardization of components and which is inexpensive.

According to the first embodiment adopted by the invention for solving the above-mentioned problems there is provided a rotary electric part comprising a case having a wall portion and a cylindrical support portion, the cylindrical support portion extending upright from the wall portion and having a through hole at its center, a cylindrical, rotatable shaft member fitted on the support portion of the case, a rotary member which is mounted on the shaft member and which can be rotated with rotation of the shaft member, contact pieces provided on either the case side or the rotary member side, and a conductive pattern provided on either the case side or the rotary member side, wherein the shaft member and the rotary member are formed as separate members, the shaft member is provided with a first snap leg portion, and the rotary member is mounted to the shaft member by the first snap leg portion.

According to the second embodiment for solution adopted by the invention there is provided, in combination with the first means, a rotary electric part further including a housing covering at least one side of the rotary member, and wherein the shaft member is inserted into a through hole formed centrally of the housing.

According to the third embodiment adopted by the invention there is provided, in combination with the first means, a rotary electric part wherein the shaft member has a stepped portion and the rotary member is engaged with the stepped portion and is held grippingly by both the stepped portion and the first snap leg portion.

According to the fourth embodiment adopted by the invention there is provided, in combination with the first embodiment, a rotary electric part wherein the first snap leg portion extends axially and is opposed in proximity to an outer peripheral surface of the support portion of the case.

According to the fifth embodiment adopted by the invention there is provided, in combination with the first means, a rotary electric part wherein an outer periphery of the shaft member is formed with a radially extending shoulder portion, and the first snap leg portion extends to one side in the axial direction with the shoulder portion as a boundary.

According to the six embodiment there is provided, in combination with the first means, a rotary electric part wherein the first snap leg portion is provided three or more.

According to the seventh embodiment adopted by the invention there is provided, in combination with the fifth means, a rotary electric part wherein the shaft member is provided with a second snap leg portion, the second snap leg portion extending to the opposite side in the axial direction with the shoulder portion as a boundary.

According to the eighth embodiment adopted by the invention there is provided, in combination with the fifth means, a rotary electric part wherein the rotary member and the housing are fitted on the shaft portion of the shaft member on the side where the first snap leg portion is provided.

According to the ninth embodiment adopted by the invention there is provided, in combination with the first means, a rotary electric part wherein the rotary member comprises a rotor having a concave-convex portion which constitutes a click mechanism and an insulating substrate disposed on the rotor and provided with the foregoing conductive pattern or contact pieces, and the first snap leg portion is engaged with the insulating substrate.

According to the tenth embodiment adopted by the invention there is provided, in combination with the ninth means, a rotary electric part wherein the concave-convex portion is provided on an outer circumferential portion of the rotor and is positioned inside the contour of the insulating substrate.

DETAILED DESCRIPTION OF THE PREFERRED EMBODIMENT

Figure 1:
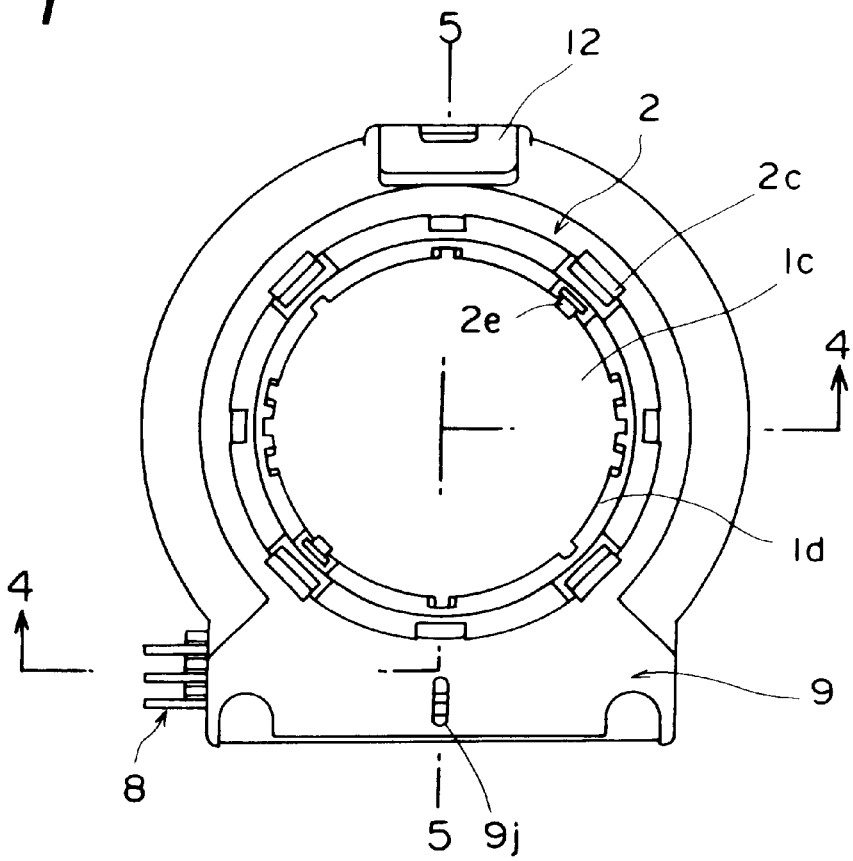
FIG. 1 is a plan view of a rotary electric part embodying the present invention.
Figure 2:
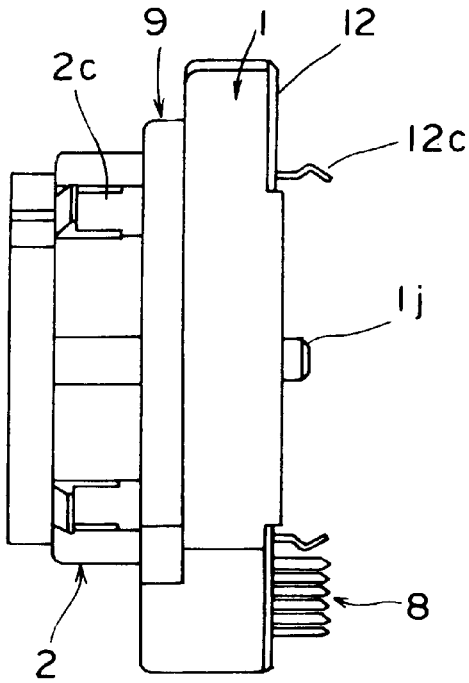
FIG. 2 is a side view of the rotary electric part.
Figure 3:
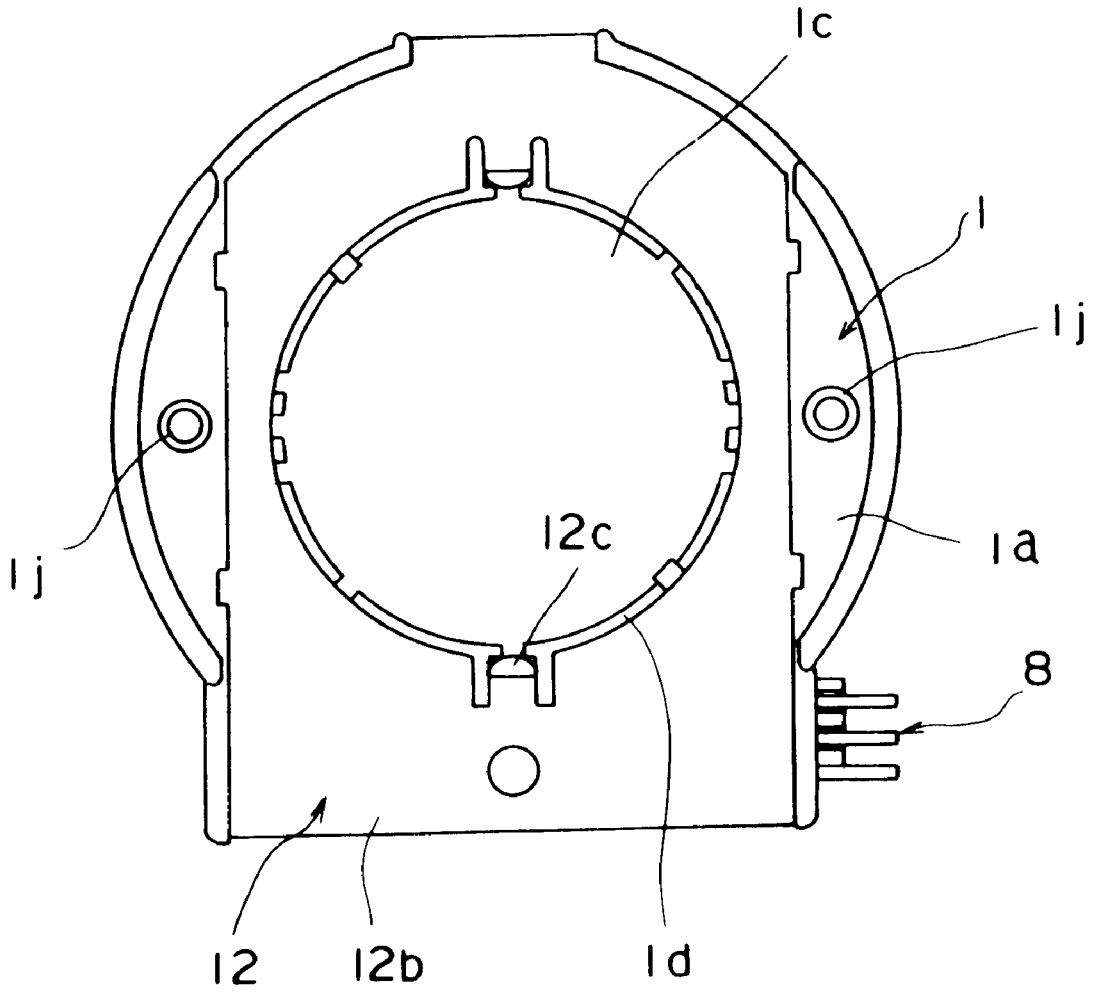
FIG. 3 is a bottom view of the rotary electric part.

The construction of the rotary electric part embodying the present invention will now be described with reference to FIGS. 1 to 31. As shown particularly in FIG. 9 and FIGS. 10 to 12, a case 1, which is formed by molding a synthetic resin, comprises a flat plate-like wall portion 1*a* formed in a generally horseshoe shape by both an arcuate portion and a generally rectangu1ar portion, a side wall 1*b* erected upright from an outer periphery of the wall portion 1*a* exclusive of a part thereof, a cylindrical support portion 1*d* formed along an inner periphery of the wall portion 1*a* and having a through hole 1*c*, a plurality of snap leg portions 1*e* formed on a free end side of the support portion 1*d* and with retaining pawls positioned on the through hole 1*c* side, and ribs 1*f* formed by a combination of arcuate ribs and radial ribs on the wall portion 1*a* located between the side wall 1*b* and the support portion 1*d*.

The case 1 has a receptacle portion 1*g* formed in a generally rectangular space of the wall portion 1*a*, a plurality of projections 1*h* formed on the wall portion 1*a* positioned in the receptacle portion 1*g*, and a positioning convex portion 1*j* formed on the exterior of the wall portion 1*a*. In the case 1, the portions surrounded with the ribs 1*f* (hatching portions in the figure) are formed thin. By forming such thin-walled portions, not only the material cost is reduced, but also sink after formation is diminished to improve the dimensional accuracy.

As shown particularly in FIG. 9 and FIGS. 13 to 16, a shaft member 2, which is formed by molding a synthetic resin, has a cylindrical shoulder portion 2*a* formed at an axially intermediate position of an outer periphery of the shaft member and extending radially, a plurality (three or more) of first snap leg portions 2*b* formed on one axial end side with the shoulder portion 2*a* as a boundary and having retaining pawls positioned outside, a plurality of second snap leg portions 2*c* formed on the axially opposite side with the shoulder portion 2*a* as a boundary at positions different from the first snap leg portions 2*b*, the second snap leg portions 2*c* having retaining pawls positioned outside, and stepped portions 2*g* formed at one end of the shaft member 2.

The cylindrical support portion 1*d* of the case 1 is inserted into the cylindrical interior of the shaft member 2, which shaft member is rotatable with a support portion 1*d* as a shaft.

In this case, the axially extending first snap leg portions 2*b* are opposed in proximity to an outer peripheral surface of the support portion 1*d*.

A rotary member 3, which is formed separately from the shaft member 2, comprises a rotor 4 formed by molding a synthetic resin and an insulating substrate 5 combined with the rotor 4.

The rotor 4 and the insulating substrate 5 may be formed integrally by molding a synthetic resin.

As shown in FIG. 9 and FIGS. 17 to 20, the rotor 4 comprises a cylindrical portion 4*a*, a flange portion 4*b* formed at an axially intermediate position of an outer periphery of the cylindrical portion 4*a* and extending radially, a fan-shaped stopper portion 4*c* further projecting from the flange portion 4*b*, a concave-convex portion 4*d* comprising plural concaves and convexes and formed on an outer circumference of the cylindrical portion 4*a* of a larger diameter located on one side with the flange portion 4*b* as a boundary, a plurality of slots 4*e* formed axially in the cylindrical portion 4*a* of a smaller diameter located on the opposite side with the flange portion 4*b* as a boundary, a protrusion 4*f* formed at a position where the flange portion 4*b* and the stopper portion 4*c* overlap each other, and arcuate stepped portions 4*g* formed on both sides of the slots 4*e* in the interior of the cylindrical portion.

Figure 9:
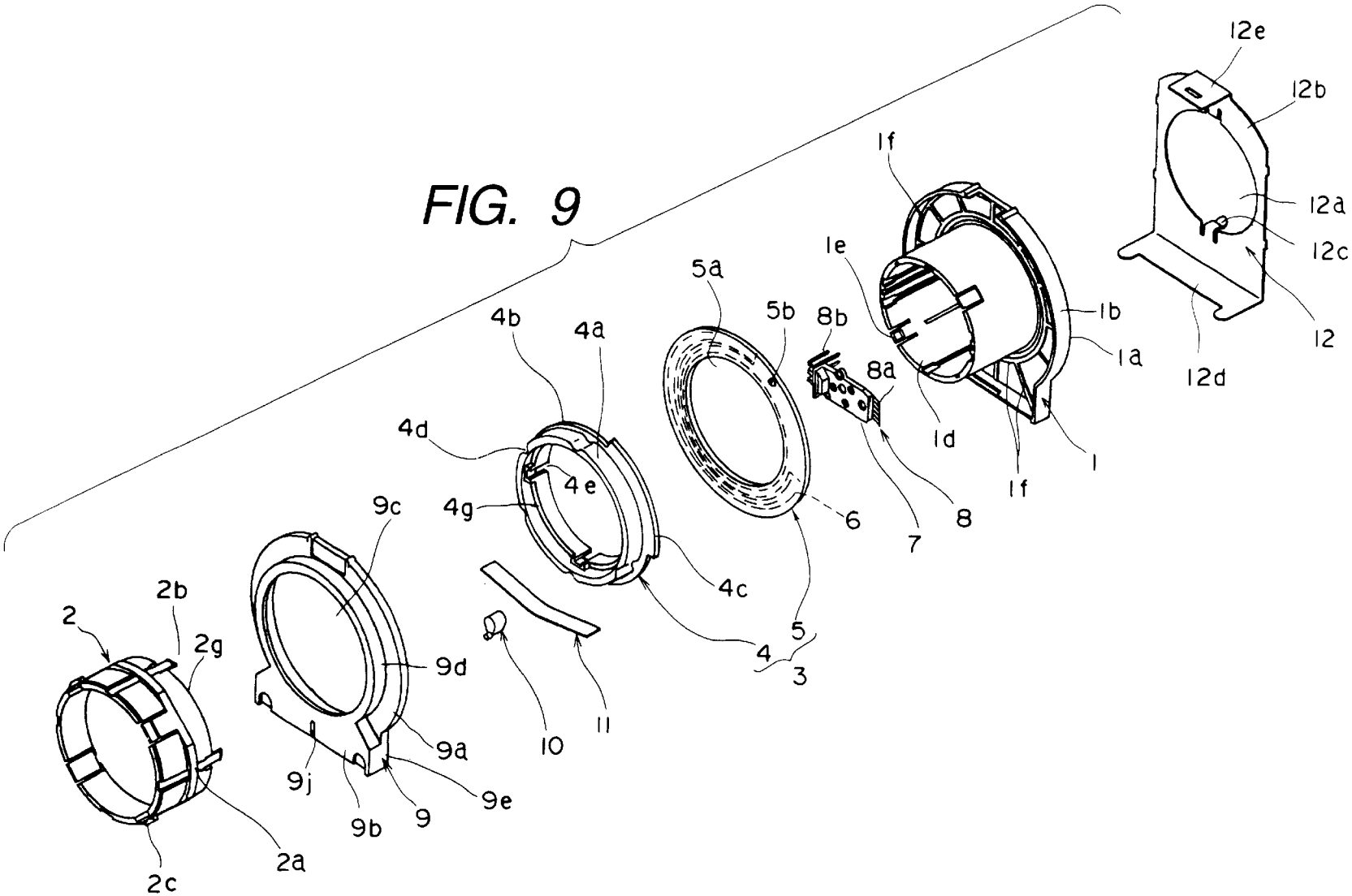
FIG. 9 is an exploded perspective view of the rotary electric part.
Figure 10:
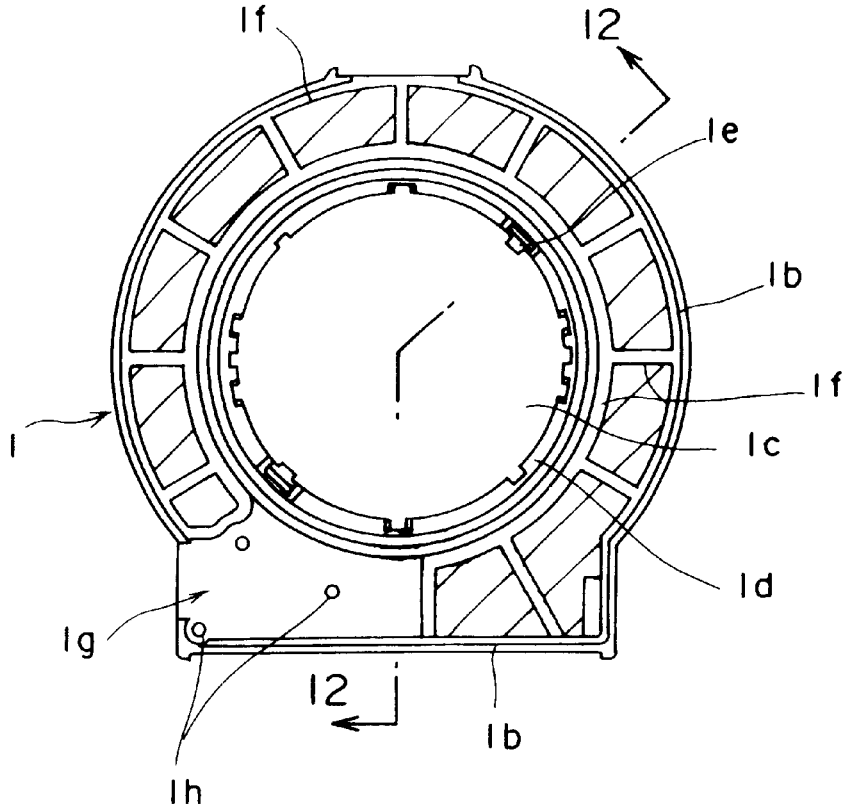
FIG. 10 is a plan view of a case used in the rotary electric part.
Figure 11:
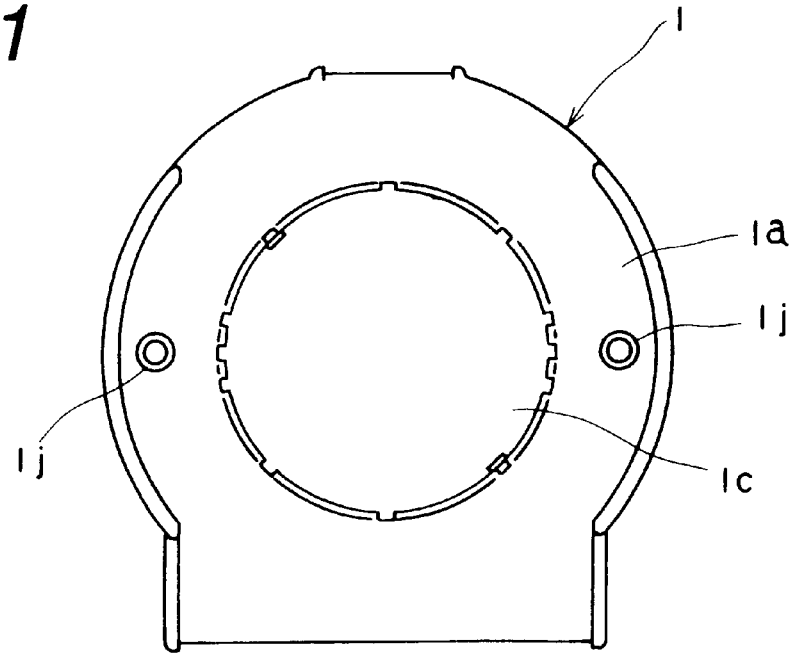
FIG. 11 is a bottom view of the case.
Figure 12:
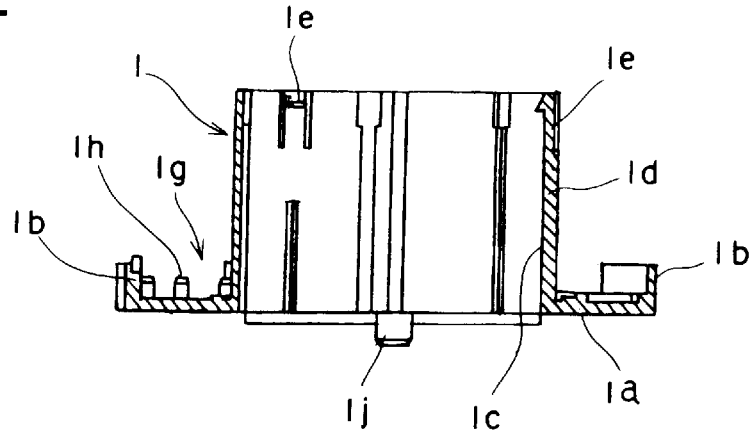
FIG. 12 is a sectional view taken on line 12—12 in FIG. 10.
Figure 13:
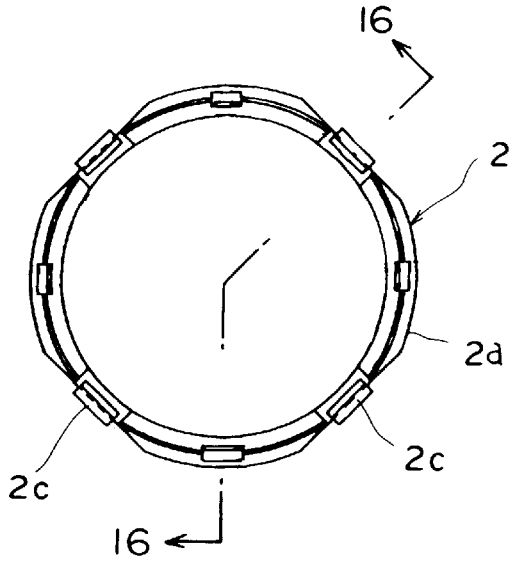
FIG. 13 is a plan view of a shaft member used in the rotary electric part.
Figure 14:
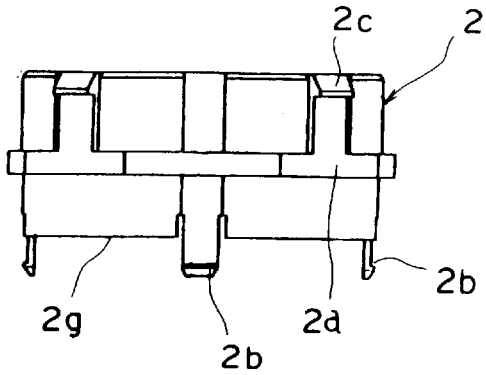
FIG. 14 is a front view of the shaft member.
Figure 15:
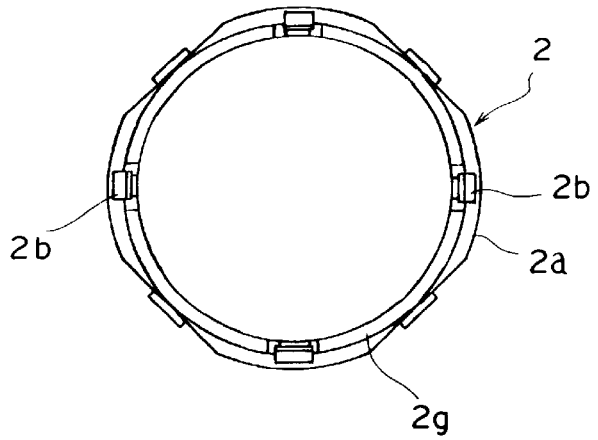
FIG. 15 is a bottom view of the shaft member.
Figure 16:
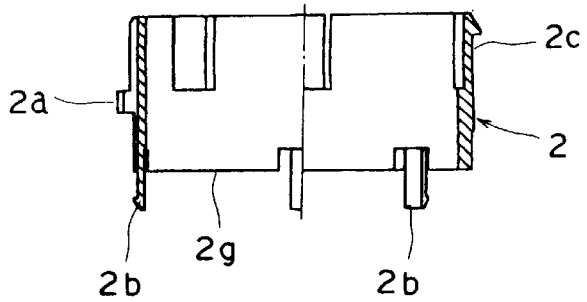
FIG. 16 is a sectional view taken on line 16—16 in FIG. 13.
Figure 17:
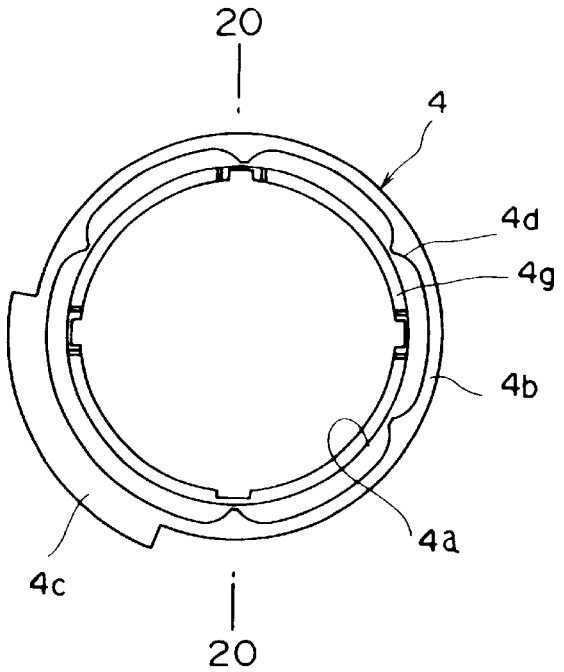
FIG. 17 is a plan view of a rotor used in the rotary electric part.
Figure 18:
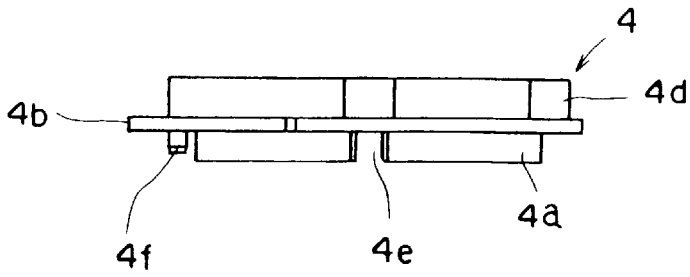
FIG. 18 is a front view of the rotor.
Figure 19:
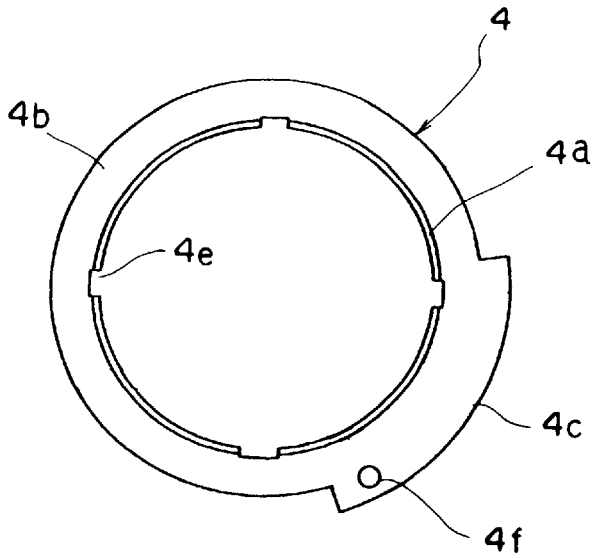
FIG. 19 is a bottom view of the rotor.
Figure 20:
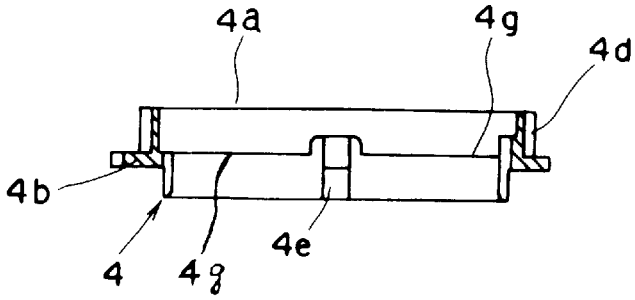
FIG. 20 is a sectional view taken on line 20—20 in FIG. 17.

As shown particularly in FIG. 9, the insulating substrate 5 is formed in the shape of a ring and has a large central hole 5*a* and a small hole 5*b* formed in an outer periphery of the substrate. On one side of the insulating substrate 5 is formed a conductive pattern 6 which is, for example, a code pattern of a conductor.

The cylindrical portion 4*a* of a smaller diameter located on the opposite side of the rotor 4 is inserted through the hole 5*a* of the insulating substrate 5 and the protrusion 4*f* is fitted in the hole 5*b*. In this state, on the side free of the conductive pattern 6 the insulating substrate 5 is superimposed on one sides of the flange portion 4*b* and the stopper portion 4*c*.

At this time, the concave-convex portion of the rotor 4 is positioned inside the contour of the insulating substrate 5.

In this way the insulating substrate 5 is superimposed on the flange portion 4*b*, the cylindrical portion 4*a* is inserted through the hole 5*a*, the protrusion 4*f* is inserted through the hole 5*b*, and thus the rotor 4 and the insulating substrate 5 are established their position in the plate surface direction. After the rotary member 3 is thus assembled, the shaft member 2 is inserted into the cylindrical portion 4*a* of the rotor 4, the first snap leg portions 2*b* pass through the slots 4*e* and are engaged with the insulating substrate 5 (snap-fastened to the substrate on the side where the conductive pattern 6 is formed), and the rotary member 3 is combined with the shaft member 2 and can rotate together with the shaft member.

At this time, the stepped portions 2*g* of the shaft member 2 come into abutment against the stepped portions 4*g* of the rotor 4 and the rotary member 3 is held grippingly by both the stepped portions 2*g* and the first snap leg portions 2*b*.

With the shaft member 2 mounted to the case 1, the insulating substrate 5, on its side where the conductive pattern 6 is formed, is in close proximity to the ribs 1*f*.

Figure 4:
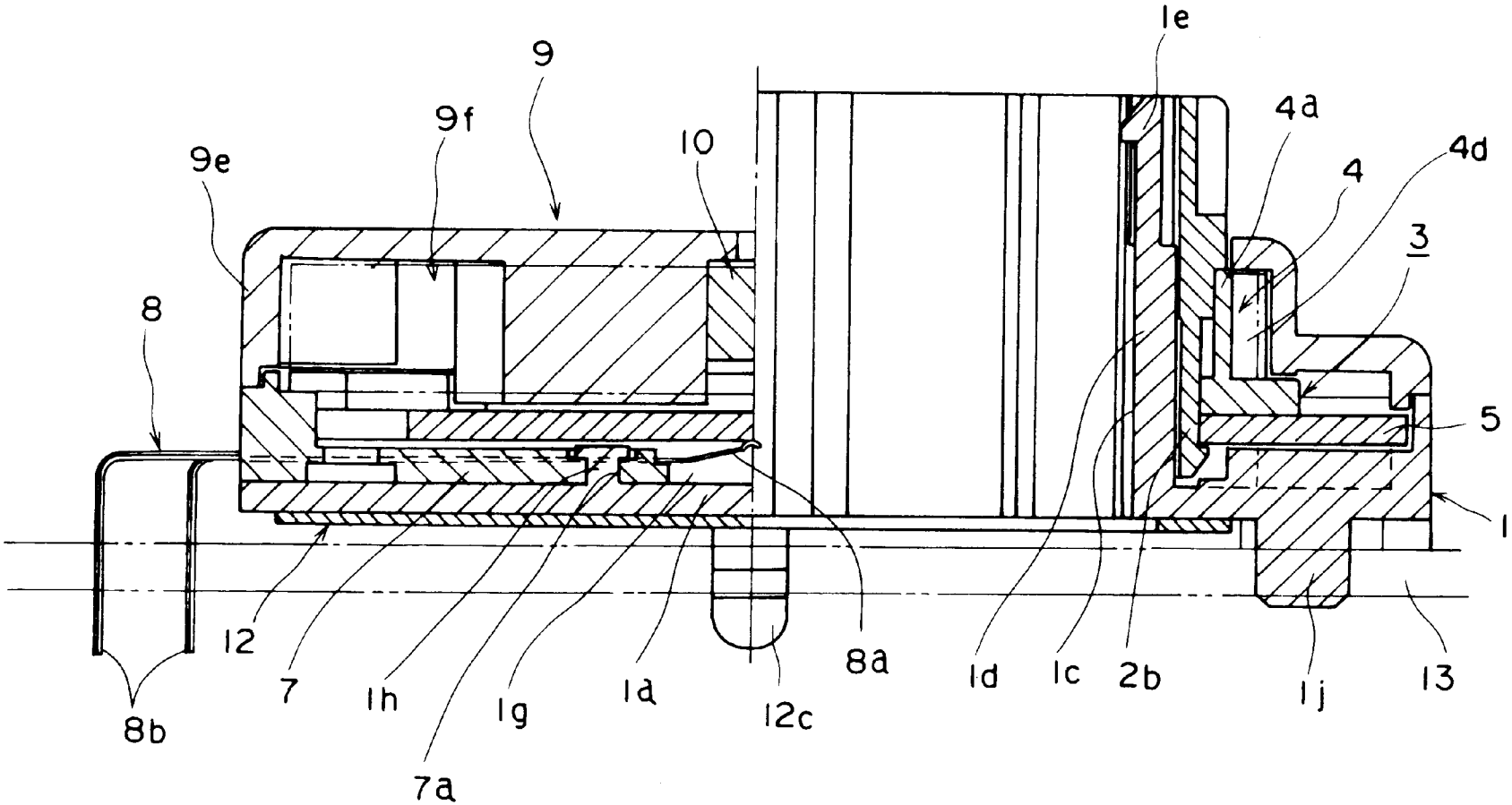
FIG. 4 is a sectional view taken on line 4—4 in FIG. 1.
Figure 5:
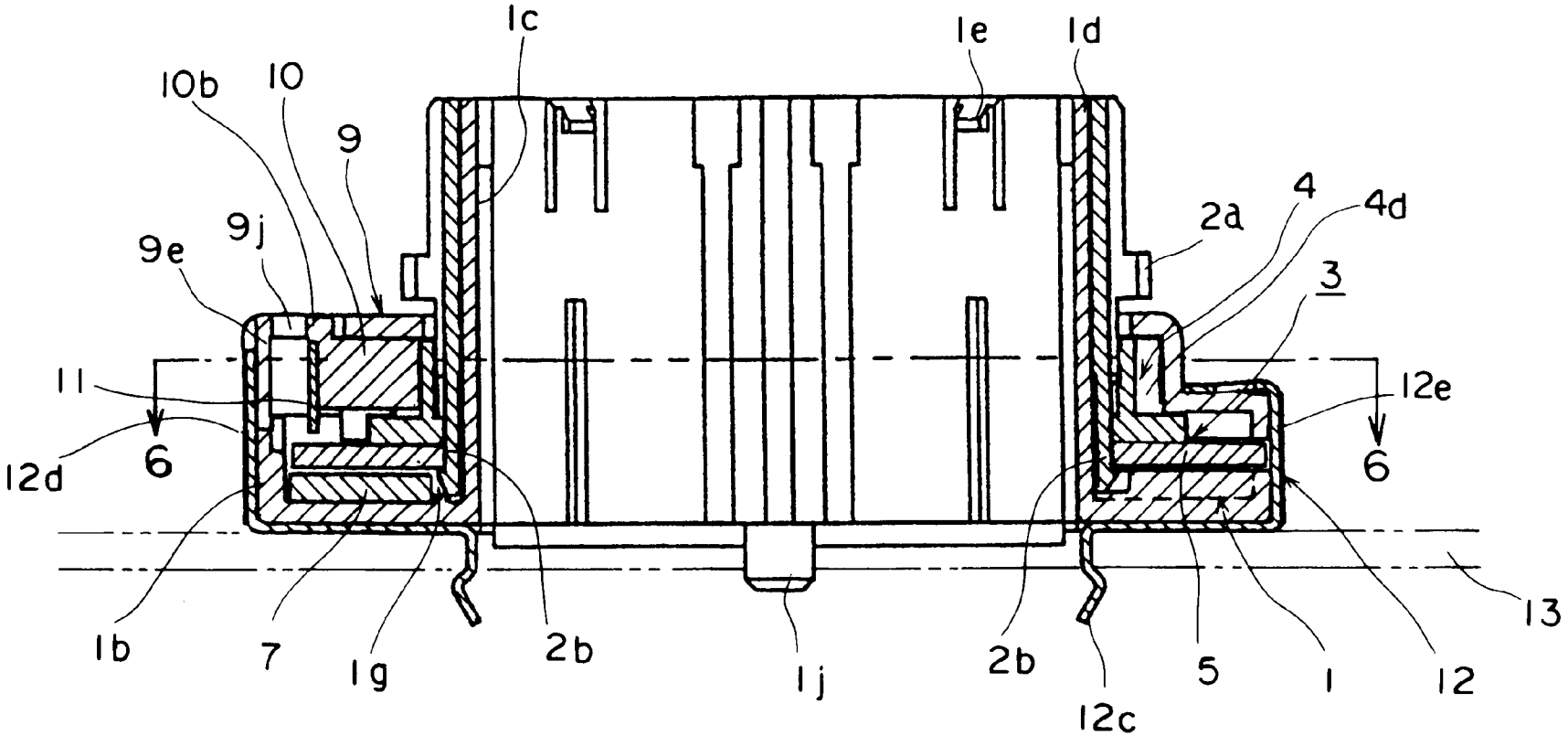
FIG. 5 is a sectional view taken on line 5—5 in FIG. 1.
Figure 6:
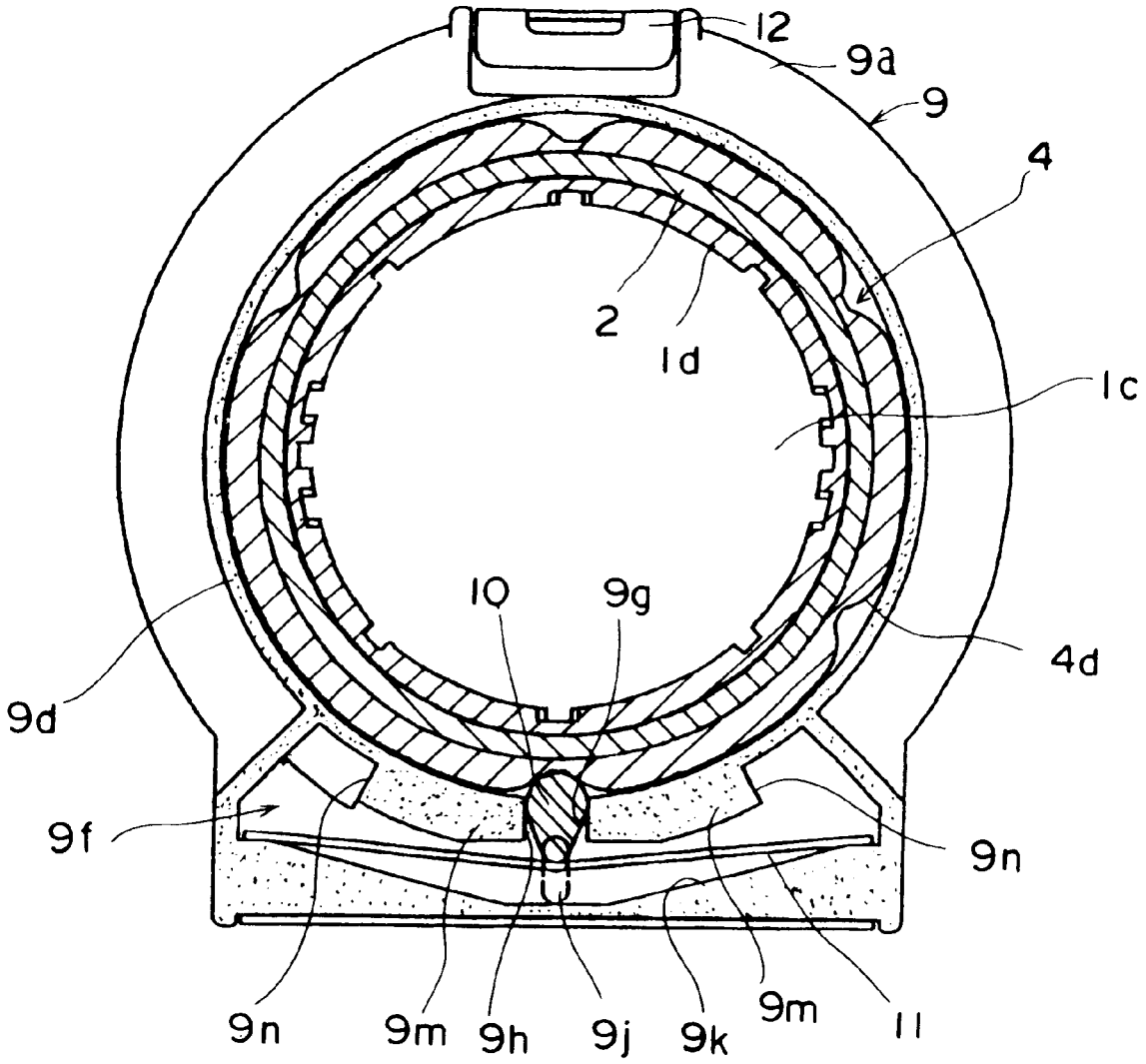
FIG. 6 is a sectional view taken on line 6—6 in FIG. 5.

As is seen from FIG. 4 or FIG. 5, the snap leg portions 2*b* are formed at a rather lower position so as to form a slight clearance between them and the support portion 1*d*.

Since the clearance is a slight clearance, even if the snap leg portions 2*b* are deflected inwards, they come into abutment against the support portion 1*d* and are thereby prevented from being disengaged from the insulating substrate 5.

Figure 21:
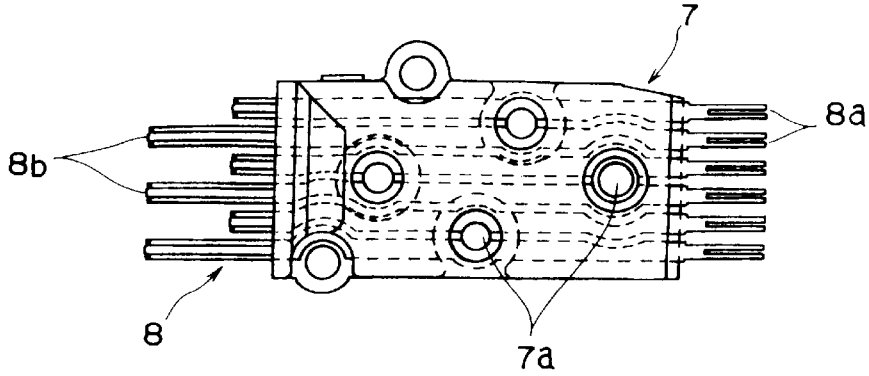
FIG. 21 is a plan view of an insulating substrate used in the rotary electric part.
Figure 22:
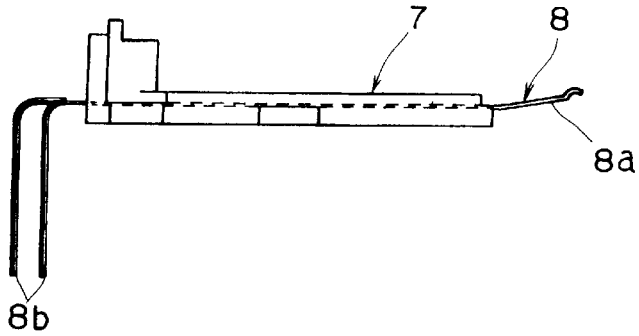
FIG. 22 is a front view of the insulating substrate.
Figure 23:
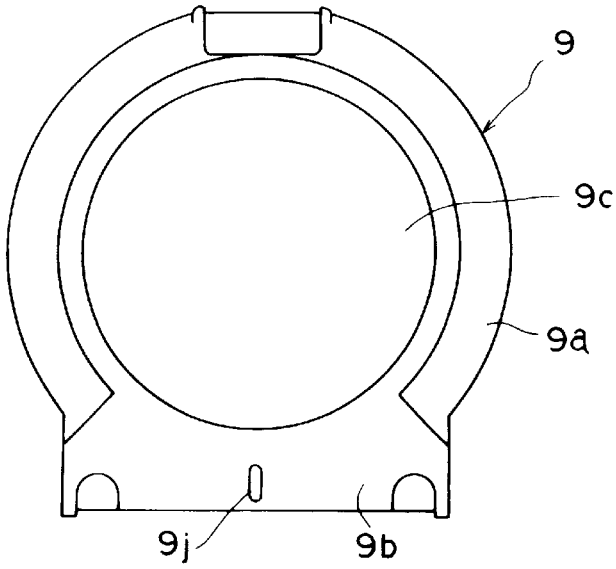
FIG. 23 is a plan view of a housing used in the rotary electric part.
Figure 24:
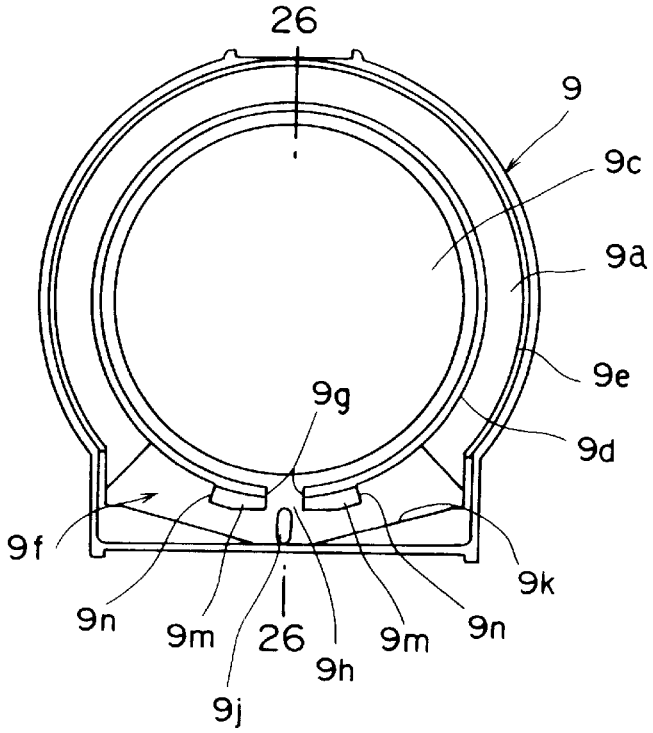
FIG. 24 is a bottom view of the housing.
Figure 25:
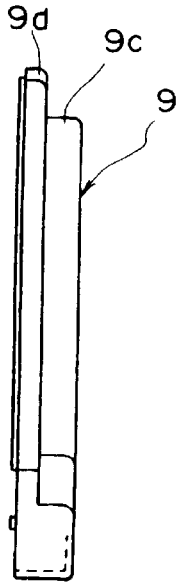
FIG. 25 is a side view of the housing.
Figure 26:
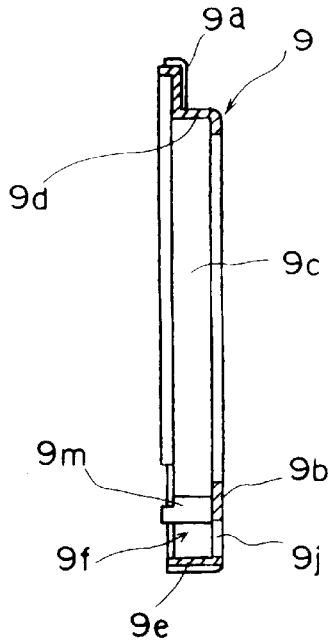
FIG. 26 is a sectional view taken on line 26—26 in FIG. 24.

A rectangular insulating substrate 7 is formed by molding a synthetic resin and, as shown particularly in FIGS. 9, 21, and 22, it has a plurality of holes 7*a*. In the insulating substrate 7 are embedded a plurality of contact pieces 8 having contact portions 8*a* and terminal portions 8*b* and each constituted by a metallic sheet.

As shown particularly in FIG. 4, with the projections 1*h* of the case 1 inserted into the holes 7*a*, the insulating substrate 7 is received in the receptacle portion 1*g* of the case 1 and upper ends of the projections 1*h* are heat-caulked, whereby the substrate 7 is secured to the case 1.

When the insulating substrate 7 is thus secured to the case 1, the contact portions 8*a* contact the conductive pattern 6 and the terminal portions 8*b* are projected to the exterior from the case 1. As the insulating substrate 5 rotates with rotation of the shaft member 2, the conductive pattern 6 comes into and out of contact with plural contact pieces 8 to generate pulses.

The conductive pattern 6 may be formed on the case 1 side and the contact pieces 8 may be provided on the rotary member 3 side.

In this way there is formed a rotary electric part. Although the rotary electric part of this embodiment is shown as an encoder, it may be a variable resistor for example.

As shown particularly in FIG. 9 and FIGS. 23 to 26, a housing 9 formed by molding a synthetic resin and constituting a holding member is substantially the same in shape as the case 1. The housing 9 has an arcuate flat plate-like wall portion 9*a*, a generally rectangular wall portion 9*b* stepped from the wall portion 9*a*, a ring-like inner wall 9*d* erected along an inner periphery of the arcuate wall portion 9*a* and having a through hole 9*c*, and an outer wall 9*e* erected on outer peripheries of the arcuate wall portion 9*a* and the rectangular wall portion 9*b*.

The housing 9 is further provided with a receptacle portion 9*f* formed by being surrounded with the inner and outer walls 9*d*, 9*e* in the position of the rectangular wall portion 9*b*, a recess 9*h* positioned within the receptacle portion 9*f* and having relatively wide side walls 9*g*, the recess 9*h* being formed by cutting off a portion of the inner wall 9*d* and by a pair of projections 9*m* which are formed at spaced positions and which constitute a stopper portion, an elongated concave groove 9*j* formed in the rectangular wall portion 9*b* on a line connecting the center of the through hole 9*c* with a middle part of the recess 9*h*, and a chevron-shaped shoulder portion 9*k* formed within the receptacle portion 9*f* and with the groove 9*j* being present at the top of the shoulder portion.

The cylindrical portion of the shaft member 2 is inserted into the central through hole 9*c* of the housing 9 and the shaft member 2 is rotatable with respect to the housing 9.

The following description is now provided about how to assemble the housing 9, the rotor 4 as the rotary member 3 and the insulating substrate 5 relative to the shaft member 2. First, the shaft portion of the shaft member 2 on the side where the first snap leg portions 2*b* are present is inserted into the through hole 9*c* of the housing 9 and the housing is secured to the shaft portion.

Next, the insulating substrate 5 is superimposed on the flange portion 4*b* of the rotor 4 to constitute the rotary member 3 as a combination of the rotor and the insulating substrate. The shaft portion of the shaft member 2 on the first snap leg portions 2*b* side is then inserted into the cylindrical portion 4*a* of the rotor 4 as a constituent of the rotary member 3.

Further, the first snap leg portions 2*b* of the shaft member 2 pass through the slots 4*e* and are engaged with the insulating substrate 5 (snap-fastened to the side where the conductive pattern 6 is formed). The stepped portions 2*g* of the shaft member 2 come into abutment against the stepped portions 4*g* of the rotor 4 and the rotary member 3 is held grippingly by both stepped portions 2*g* and first snap leg portions 2*b*.

At this time, the housing 9 covers one side of the rotary member 3 and one end of the housing strikes against and is retained by the shoulder portion 2*a* of the shaft member 2, whereby the housing 9 is prevented from coming off the shaft member 2. In this way the housing 9, rotor 4 and insulating substrate 5 are mounted and assembled onto the shaft member 2.

In this assembled state, the flange portion 4*b* and the fan-shaped stopper portion 4*c* of the rotor 4 are lapped on the inner surface of the wall portion 9*a* of the housing 9.

As the rotor is rotated by the shaft member 2 relative to the housing 9 which is in a fixed state, a fan-shaped end of the stopper portion 4*c* strikes against an end 9*n* of a projection 9*m* to stop the rotation of the rotor 4 and of the shaft member 2.

The shaft member 2 with the housing 9, rotor 4 and insulating substrate 5 mounted thereon is fitted on the support portion 1*d* of the case 1 so that the external forms of the arcuate and rectangular wall portions 9*a*, 9*b* of the housing 9 are in conformity with the external forms of the arcuate and rectangular portions of the case 1.

Figure 27:
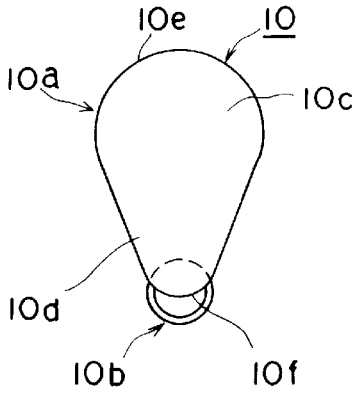
FIG. 27 is a plan view of a click member used in the rotary electric part.
Figure 28:
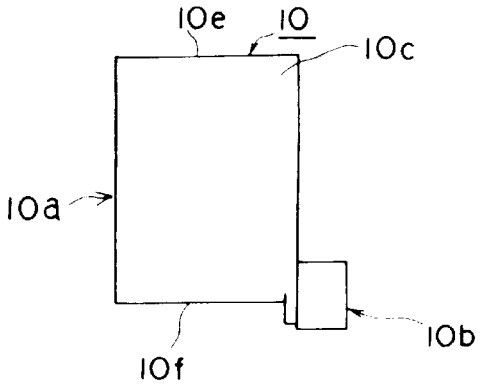
FIG. 28 is a side view of the click member.
Figure 29:
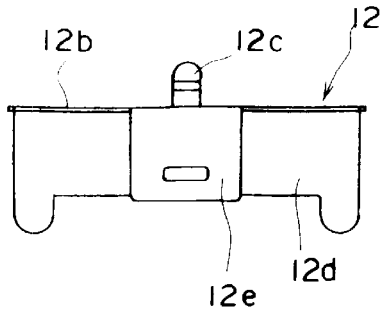
FIG. 29 is a front view of a mounting plate used in the rotary electric part.
Figure 30:
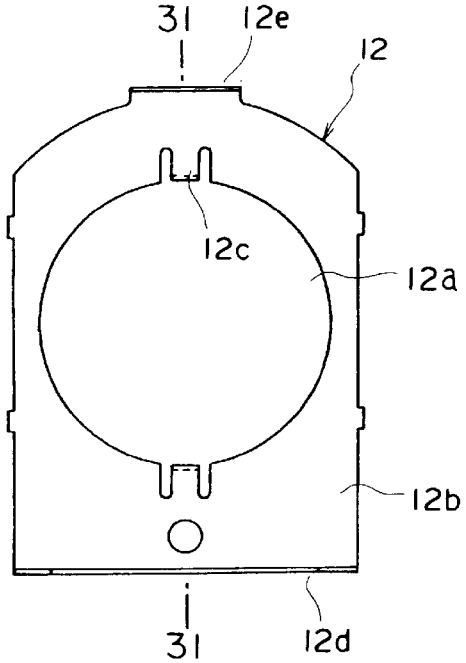
FIG. 30 is a bottom view of the mounting plate.
Figure 31:
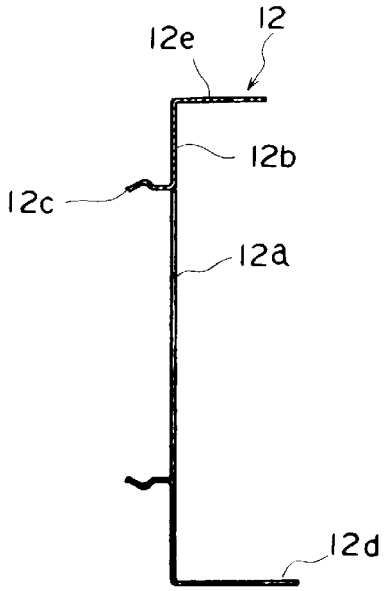
FIG. 31 is a sectional view taken on line 31—31 in FIG. 30.
Figure 32:
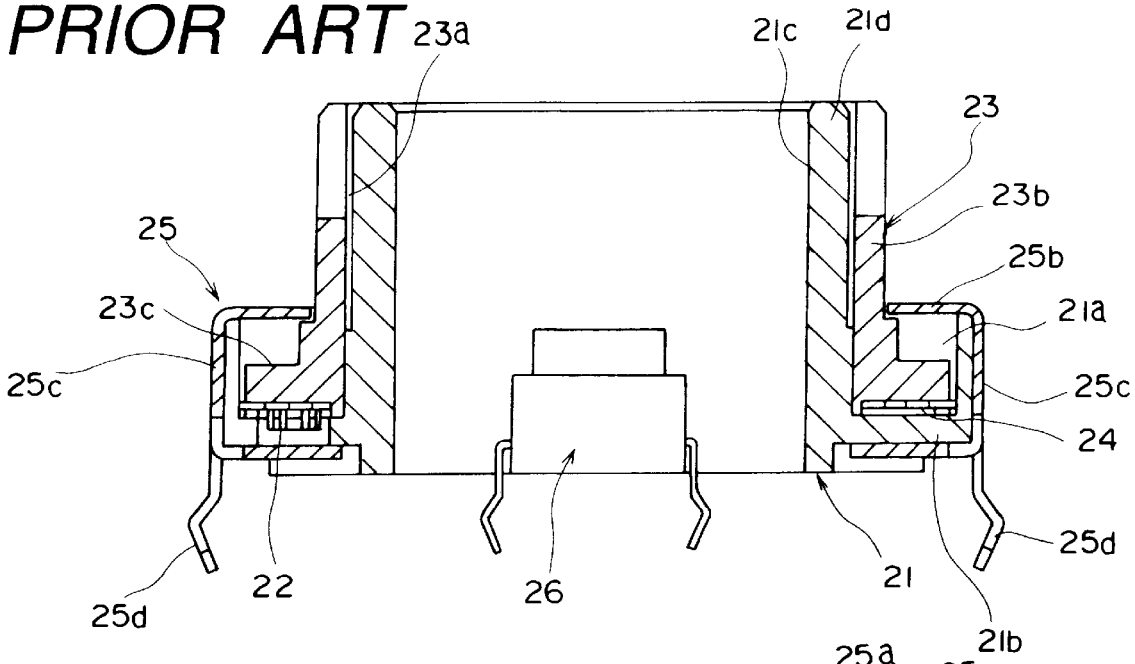
FIG. 32 PRIOR ART
FIG. 32 is a sectional view of a conventional rotary electric part.
Figure 33:
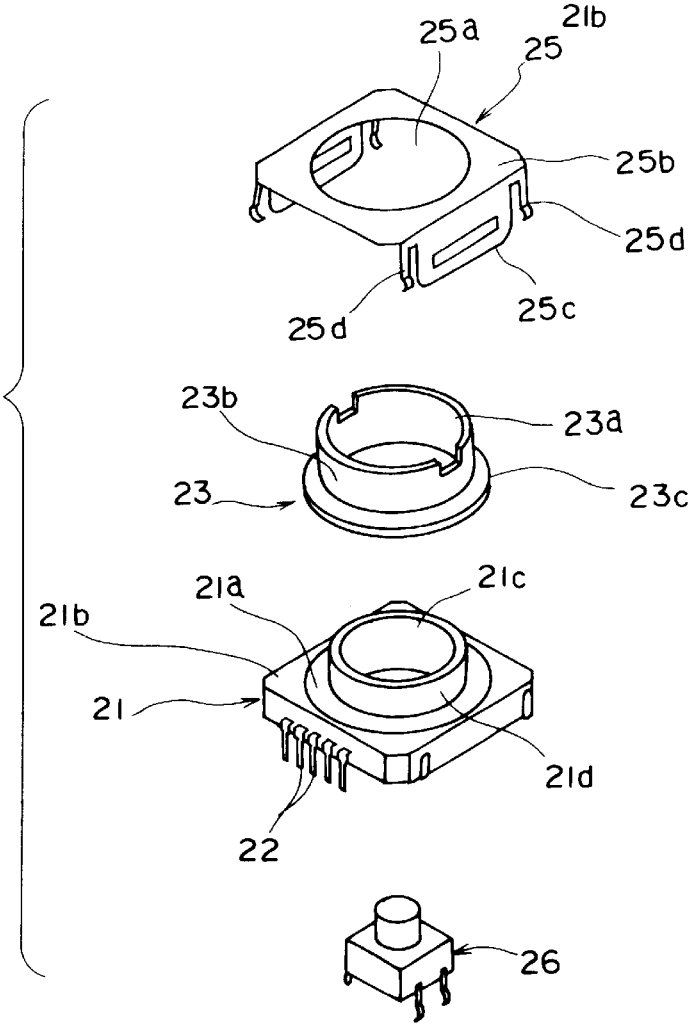
FIG. 33 PRIOR ART
FIG. 33 is an exploded perspective view thereof.

As shown particularly in FIGS. 27 and 28, a click member 10, which is formed by molding a synthetic resin, comprises a body 10*a* and a convex portion 10*b* formed upright from the body portion 10*a*.

In the body 10*a*, an end of a front portion 10*c* is formed as an arcuate surface 10*e* having a radius larger than that of a rear portion 10*d*, and an end of the rear portion 10*d* is formed as an arcuate surface 10*f* having a radius smaller than that of the front portion 10*c*. The front portion 10*c* is wider than the rear portion 10*d*.

On the rear portion 10*d* side the convex portion 10*b* is projected upright from one side of the body 10*a* so as to partially protrude (overhang) from the end of the rear portion 10*d*.

The click member 10 thus constructed is disposed within the receptacle portion 9*f* of the housing 9 so that the front portion 10*c* is positioned within the recess 9*h* and both sides thereof are supported by the side walls 9*g*. Further, the convex portion 10 is fitted in the groove 9*j*. The click member 10, which is mounted in such a state, is movable radially while being guided by both side walls 9*g* and groove 9*j*.

A biasing member 11 is formed separately from the click member 10, using a spring member such as a metallic plate spring or piano wire. As shown particularly in FIG. 6, the biasing member 11 is disposed in the receptacle portion 9*f* of the housing 9, and with its both end portions abutted against the shoulder portion 9*k*, a central part of the biasing member is in abutment against the arcuate surface 10*f* located at an end of the rear side 10*d* of the click member 10, urging the click member toward the center of the through hole 9*c*.

The front portion 10*c* of the click member 10 attached movably to the housing 9 is brought into elastic pressure contact with the concave-convex portion 4*d* of the rotor 4 by means of the biasing member 11, and with rotation of the rotor 4 the click member 10 is engaged with and disengaged from the concave-convex portion 4*d* and generates a click feeling. Thus, a click mechanism is constituted.

Further, in the click member 10, one side of the body 10*a* is placed on the housing 9 and the flange portion 4*b* of the rotor 4 comes into abutment against a part on the opposite side of the front portion 10*c* of the body 10*a*. Thus, both sides of the click member 10 are held grippingly by the housing 9 and the rotor 4.

As shown particularly in FIG. 9 and FIGS. 29 to 31, a mounting plate 12, which is a metallic plate, comprises a flat plate portion 12*b* having a hole 12*a*, a plurality of mounting legs 12*c* bent from a peripheral edge of the hole 12*a*, a leg portion 12*d* of a large width bent from one end of the flat plate portion 12*b* in the direction opposite to the mounting legs 12*c*, and a leg portion 12*e* of a small width bent from the opposite end of the flat plate portion 12*b* in the direction opposite to the mounting legs 12*c*.

The flat plate portion 12*b* of the mounting plate 12 is put on the wall portion 1*a* of the case 1, the leg portion 12*d* of a large width is positioned outside the rectangular portion of the case 1, allowing the case 1 and the housing 9 to be embraced by a pair of the leg portions 12*d* and 12*e*, and thereafter tip ends of the leg portions 12*d* and 12*e* are bent at a right angle toward the wall portions 9*a* and 9*b* of the housing 9.

As a result, the housing 9 and the shaft member 2 are mounted to the case 1 by the mounting plate 12.

As shown in FIGS. 4 and 5, the rotary electric part thus constructed is put on a printed circuit board and the convex portion 1*j* of the case 1 is inserted into a hole (not shown) of the printed circuit board, whereby the rotary electric part is established its position relative to the printed circuit board. Further, the terminal portions 8*b* of the contact pieces 8 and the mounting legs 12*c* of the mounting plate 12 are fitted in the printed circuit board and soldered. In this way, mounting of the rotary electric part and wiring are performed for the printed circuit board 13.

On the printed circuit board 13 positioned within the through hole 1*c* of the case 1 is disposed a push-button switch though not shown.

Though not shown, either, a knob is attached to the shaft member 2. With one end of the knob abutted against the shoulder portion 2*a*, the second snap leg portions 2*c* are engaged with the knob, allowing the knob to be held grippingly by both the shoulder portion 2*a* and the second snap leg portions 2*c*.

The operation of the rotary electric part having the above construction will now be described. First, when the shaft member 2 is rotated, it rotates with the support portion 1*d* of the case as a shaft together with the rotor 4 and the insulating substrate 5 as constituents of the rotary member 3.

With rotation of the rotor 4, the front portion of the click member 10 positioned in a valley of the concave-convex portion 4*d* is pushed out backward by a crest of the concave-convex portion 4*d* against the resilience of the biasing member 11.

Figure 7:
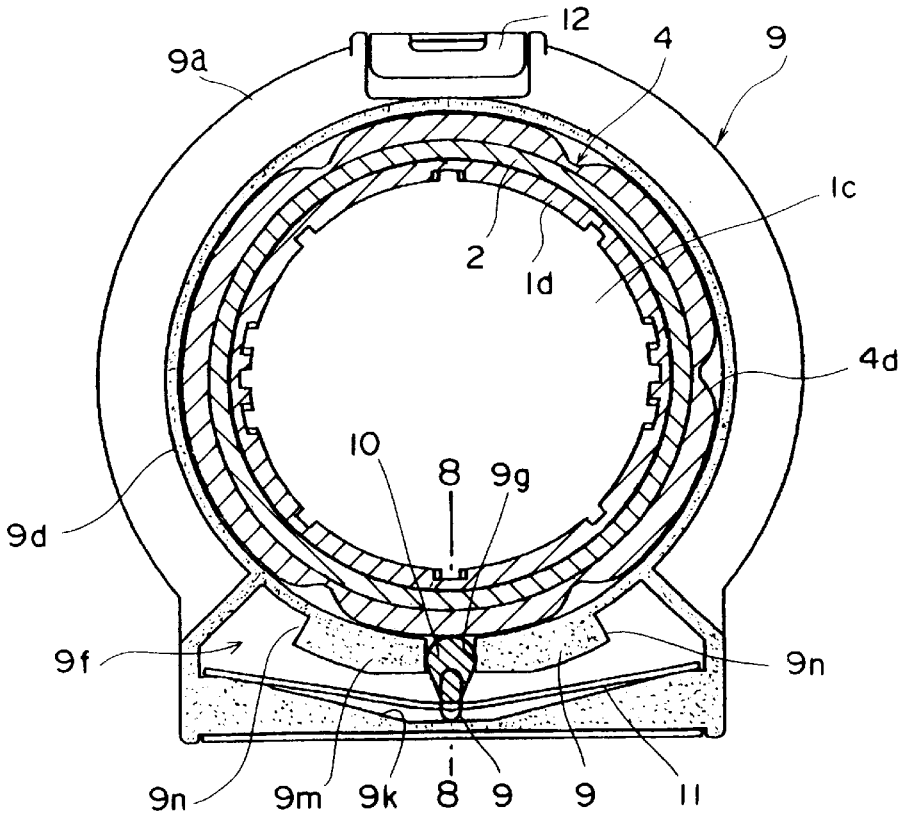
FIG. 7 is an explanatory diagram illustrating the operation of the rotary electric part.
Figure 8:
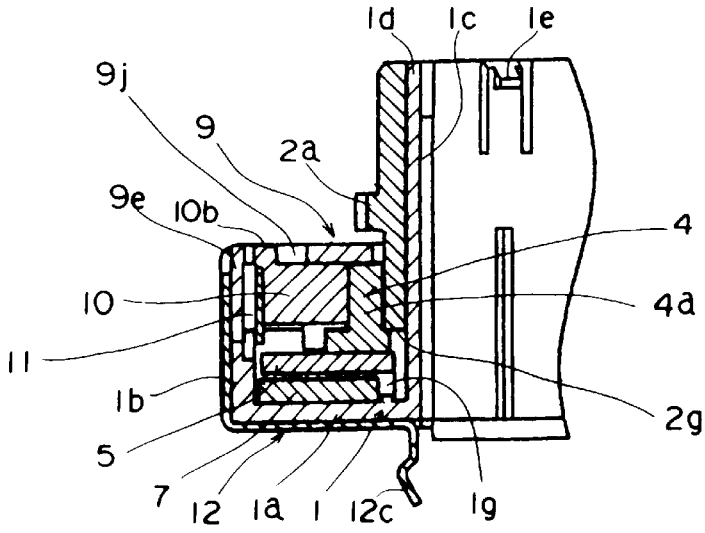
FIG. 8 is a sectional view taken on line 8—8 in FIG. 7.

At this time, the front portion 10*c* of the click member 10 is guided by the side walls 9*g* of the recess 9*h*, while the convex portion 10*b* is guided by the groove 9*j*, and the click member 10 moves radially, as shown in FIGS. 7 and 8.

During this radial movement the click member 10 does not wobble so much in the circumferential direction (rotational direction) because it is supported by the side walls 9*g* and the groove 9*j*.

With a further rotation of the shaft member 2, the click member 10 falls into a valley of the concave-convex portion 4*d*. In this way the click member 10 is engaged with and disengaged from the concave-convex portion 4*d,* so that the rotation of the shaft member 2 is given a click feeling.

In this embodiment, since the arcuate surface 10*f* against which the biasing member 11 comes into abutment is disposed between a rear end of the convex portion 10*b* and the front portion 10*c,* the click member 10 is difficult to tilt and can be moved radially in a stable manner. Besides, since the biasing member 11 can be disposed at a position close to the center, its radial size can be reduced.

The rotation of the shaft member 2 is stopped upon abutment of the stopper portion 4*c* of the rotor 4 against the ends 9*n* of the projections 9*m* of the housing 9. As the shaft member 2 rotates, the conductive pattern 6 also rotates together with the insulating substrate 5, whereby the contact pieces 8 come into and out of contact with the conductive pattern 6 and generate pulses.

As a result, the temperature of an air conditioner or air volume is adjusted.

Although in the above embodiment the concave-convex portion 4*d* of the rotor 4 is formed on the outer circumferential portion (a surface parallel to the axial direction), there may be adopted a modification wherein the concave-convex portion 4*d* is formed on a surface perpendicular to the axial direction of the rotor 4 and the click member 10 is pressed elastically by the biasing member 11 so as to become engaged with and disengaged from the concave-convex portion 4*d.*

Although in the above embodiment the click member 10 is held by a single holding member 9, it may be held by two holding members 9.

In the rotary electric part of the present invention, since the shaft member and the rotary member 3 are formed as separate members, both can be fabricated separately and then combined together. Thus, it is possible to standardize components and the rotary electric part using such components is less expensive than in the prior art.

Moreover, since the shaft member 2 is provided with the first snap leg portions 2*b* and the rotary member 3 is mounted to the shaft member 2 through the first snap leg portions 2*b,* their assembly is easy and the productivity is high.

Further, since the support portion 1*d* is cylindrical, another electric part, e.g., a push-button switch, can be disposed centrally of the support portion and thus the rotary electric part is superior in space factor.

Further, since the shaft member 2 is inserted into the through hole 9*c* formed centrally of the housing 9 and at least one side of the rotary member 3 is covered with the housing 9, the contact pieces 8 and the conductive pattern 6 can be covered with both case 1 and housing 9, whereby a stable contact can be ensured over a long period.

Since the shaft member 2 has stepped portions 2*g* and the rotary member 3 is engaged with the stepped portions 2*g* and are held grippingly by both the stepped portions 2*g* and the first snap leg portions 2*b,* not only the rotary member 3 can be positively mounted to the shaft member 2, but also their assembling work is easy and the productivity is high.

Further, since the first snap leg portions 2*b* extend axially and are opposed in close proximity to the outer peripheral surface of the support portion 1*d* of the case 1, the movement of the first snap leg portions 2*b* is inhibited by the support portion 1*d* and an accidental dislodgment of the rotary member 3 from the shaft member 2 is prevented, whereby the mounting of the rotary member 3 is ensured.

Further, the radially extending shoulder portion 2*a* is formed on the outer peripheral portion of the shaft member 2 and the first snap leg portions 2*b* extend to one side in the axial direction with the shoulder portion 2*b* as a boundary, so at the time of mounting a knob to the shaft member 2, the shoulder portion 2*a* functions as an axial positioning means for the knob and hence the mounting of the knob can be done always in a constant manner.

Since the first snap leg portions 2*b* are provided three or more, that is, since there are a sufficient number of holding portions for the rotary member 3, the rotary member can be held firmly and its surface inclination can be minimized, permitting the surface of the rotary member 3 to be held perpendicularly to the axial direction.

Further, since the second snap leg portions 2 of the shaft member extend to the opposite side in the axial direction with the shoulder portion 2*a* as a boundary, they can be utilized in mounting the knob. The knob can be mounted positively and easily by both the second snap leg portions 2*c* and the shoulder portion 2*a.*

Since the rotary member 3 and the housing 9 are fitted on the shaft portion of the shaft member 2 on the side where the first snap leg portions 2*b* are provided, it is not necessary to pass the shoulder portion 2*a* through the through hole 9*c* of the housing 9, so that the through hole 9*c* can be made small in size, there is attained a satisfactory dust-proof effect for the contact pieces, etc., and the shoulder portion 2*a* can cover the upper portion of the through hole 9*c,* thus leading to a further improvement of dust-proofness.

Although the knob-mounted side shaft portion with the shoulder portion 2*a* as a boundary differs in diameter depending on the knob to be mounted, the shaft portion on the side where the first snap leg portions 2*b* are provided may be same in diameter, so that the housing 9 may be used in common and the cost can be reduced.

Since the rotary member 3 is composed of the rotor 4 having the concave-convex portion 4*d* which constitutes a click mechanism and the insulating substrate 5 disposed on the rotor 4 and provided with the conductive pattern 6 or contact pieces 8 and the first snap leg portions 2*b* are engaged with the insulating substrate 5, both rotor 4 and insulating substrate 5 can be mounted simultaneously by the first snap leg portions 2*b.* Thus, the construction is simple and the productivity is high.

Further, since the concave-convex portion 4*d* is formed on an outer circumference portion of the rotor 4 and is positioned inside the contour of the insulating substrate 5, the concave-convex portion 4*d* does not protrude from the external form of the insulating substrate 5 and hence there is obtained a small-sized click mechanism.

What is claimed is:

1. A rotary electric part comprising:

a case having a wall portion and a cylindrical support portion, the cylindrical support portion extending upright from the wall portion and having a through hole at its center;

a cylindrical, rotatable shaft member fitted on the support portion of the case;

a rotary member which is mounted on the shaft member and which can be rotated with rotation of the shaft member;

contact pieces provided on either the case side or the rotary member side; and a conductive pattern provided on the other of the case side or the rotary member side, wherein the shaft member and the rotary member are formed as separate members, the shaft member is provided with a first snap leg portion, and the rotary member is mounted to the shaft member by the first snap leg portion, and wherein the rotary member comprises a rotor having a concave-convex portion which constitutes a click mechanism and an insulating substrate disposed on the rotor and provided with the conductive pattern or the contact pieces, and the first snap leg portion is engaged with the insulating substrate.

2. A rotary electric part according to claim 1, further including a housing covering at least one side of the rotary member, wherein the shaft member is inserted into a through hole formed centrally of the housing, and the housing covers the one side of the rotary member.

3. A rotary electric part according to claim 1, wherein the shaft member has a stepped portion and the rotary member is engaged with the stepped portion and is held grippingly by both the stepped portion and the first snap leg portion.

4. A rotary electric part according to claim 1, wherein the first snap leg portion extends axially and is opposed in proximity to an outer peripheral surface of the support portion of the case.

5. A rotary electric part according to claim 1, wherein an outer periphery of the shaft member is formed with a radially extending shoulder portion, and the first snap leg portion extends to one side in the axial direction with the shoulder portion as a boundary.

6. A rotary electric part according to claim 1, wherein the first snap leg portion comprises three or more separate snap legs portions.

7. A rotary electric part according to claim 5, wherein the shaft member is provided with a second snap leg portion, the second snap leg portion extending to the opposite side in the axial direction with the shoulder portion as a boundary.

8. A rotary electric part according to claim 5, wherein the rotary member and the housing are fitted on the shaft portion of the shaft member on the side where the first snap leg portion is provided.

9. A rotary electric part according to claim 1, wherein the concave-convex portion is provided on an outer circumferential portion of the rotor and is positioned inside the contour of the insulating substrate.

10. A rotary electric part comprising:

a case having a flat, plate-like wall portion and a cylindrical support portion, the cylindrical support portion extending upright from the wall portion and having a through hole at its center;

a cylindrical, rotatable shaft member fitted on an outer peripheral surface of the support portion of the case, thereby rotatably attached to the support portion;

a rotary member having the through hole passed in the support portion, which is mounted on the shaft member, and which can be rotated with rotation of the shaft member;

a housing having the through hole at its central part through which the support portion and the shaft member are passed, attached to the case and storing the rotary member in it together with the case;

contact pieces provided on either the case side or the rotary member side; and a conductive pattern provided on the other of the case side or the rotary member side, wherein the shaft member and the rotary member are formed as separate members, the shaft member is provided with a first snap leg portion, and the rotary member is mounted to the shaft member by the first snap leg portion.

11. A rotary electric part according to claim 10, wherein the shaft member has a stepped portion, the rotary member is abutted against the stepped portion, and the rotary member is held by the stepped portion and the first snap leg portion.

12. A rotary electric part according to claim 10, wherein the first snap leg portion has a click claw that extends in an axial direction, and is passed through the through pass hole of the rotor and thereafter projected outside, and the first snap leg portion is oppositely arranged in its adjoining state with the case in such a manner that it is abutted against the support portion to prevent its click from being disengaged.

* * * * *